United States Patent [19]

Oka

[11] Patent Number: 4,608,327

[45] Date of Patent: Aug. 26, 1986

[54] METHOD OF FORMING COMPOSITE IMAGES

[75] Inventor: Tateki Oka, Toyohashi, Japan

[73] Assignee: Minolta Camera Kabushiki Kaisha, Osaka, Japan

[21] Appl. No.: 631,834

[22] Filed: Jul. 17, 1984

[30] Foreign Application Priority Data

Jul. 21, 1983 [JP] Japan ..... 58-133678
Jul. 21, 1983 [JP] Japan ..... 58-133679

[51] Int. Cl.[4] ..... G03G 5/082

[52] U.S. Cl. ..... 430/54; 430/67; 430/55; 430/100

[58] Field of Search ..... 430/55, 67, 100, 54

[56] References Cited

U.S. PATENT DOCUMENTS 4,310,610 1/1982 Sakai ..... 430/55
4,329,413 5/1982 Kitamura et al. ..... 430/55
4,486,088 12/1984 Kitamura et al. ..... 430/55

FOREIGN PATENT DOCUMENTS 51-120730 10/1976 Japan .
55-62464 5/1980 Japan .
56-925507 7/1981 Japan .
58-72157 4/1983 Japan .

*Primary Examiner*—John L. Goodrow
*Attorney, Agent, or Firm*—Wenderoth, Lind & Ponack

[57] ABSTRACT

The invention disclosed relates to a method of forming composite images. A photosensitive member including an electroconductive base, a photoconductive layer and an insulation layer in a superposed arrangement is used and to this photosensitive member, a negative image is exposed while simultaneously charging, irradiating with light, charging by an a.c. corona charging means and then exposing a positive image to form a composite electrostatic latent image. If the positive image overlaps with the negative image, the positive image is formed in preference.

10 Claims, 25 Drawing Figures

METHOD OF FORMING COMPOSITE IMAGES

BACKGROUND OF THE INVENTION

1. Field of the Invention

The present invention relates to a method of forming composite images with use of a photosensitive member consisting essentially of three layers, i.e. an electroconductive layer, a photoconductive layer and an insulation layer.

2. Description of the Prior Art

In recent years, copying methods have been proposed wherein a composite image is obtained by forming a copy image from an optical image of a usual original and additionally forming another image by writing with an OFT or laser. For example, Published Unexamined Japanese Patent Application No. SHO 57-8553 discloses such a method, which comprises the following steps. In the first step, a photosensitive member is charged to a surface potential VS by a corona charger as illustrated in FIG. 1*a*. Subsequently in the second step which is shown in FIG. 1*b*, the charged photosensitive member is exposed to an optical image of a usual positive original, whereby the potential of the nonimage area is attenuated to VL, with the potential remaining approximately at VS in the image area. When the nonimage area is then exposed to a negative image with use of an OFT or laser in the third step, the potential VL is attenuated to VLL in an area corresponding to the image area as seen in FIG. 1*c*, whereby a composite electrostatic latent image is formed. The composite latent image thus formed is developed next in the fourth step, in which the developing bias voltage is set approximately to the above level VL, whereby two kinds of toners, opposite to each other in polarity, are adhered to the component latent images respectively as shown in FIG. 1*d*.

To obtain fog-free sharp composite images by the above copying method, it is critical that the potentials VS, V1 and VLL be stable. Of these, the potential VS can be provided always with good stability and ease, for example, by a scorotron charger. Stable potential VLL is available when a sufficient amount of light is used for positive image exposure. However, the intermediate potential VL between VS and VLL is often unstable because the sensitivity of the photosensitive member varies from member to member and is dependent on temperature and also because of variations in the amount of positive image exposure, etc. Difficulties are therefore encountered in setting the developing bias voltage. Although the above-mentioned publication No. SHO 57-8553 discloses means for controlling the amount of positive image exposure by detecting the potential VL, the control means makes the copying machine complex.

Furthermore, the copying method described has the drawback that in order to obtain the individual component latent images substantially with the same contrast, the intermediate potential VL needs to be approximately at the middle level between VS and VLL, thus necessitating delicate adjustment of the amount of exposure. The copying method has another drawback that when the negative image overlaps the positive image, the positive image substantially disappears. The method has still another drawback that when the image portion of the negative image is projected on the positive image in overlapping relation, both images disappear or the potentials of the two images offset each other and reduce, forming only a positive or negative image of low density.

SUMMARY OF THE INVENTION

The main object of the present invention is to provide a method of forming satisfactory composite images from negative and positive images.

Another object of the invention is to provide a composite image forming method wherein the potential of the background area is made constant at all times to give satisfactory composite images free from fog, and when the photosensitive member is exposed to overlapping positive and negative images, preference is given to one of the negative and positive images to obtain a satisfactory visible image.

Still another object of the invention is to provide a method of forming composite images under conditions which are easily settable for each step and by a simplified system, using a photosensitive member which consists essentially of an electroconductive layer, a photoconductive layer and an insulation layer.

These and other objects of the present invention can be fulfilled by one of the following two methods of forming a composite image. The first method comprises the first step of charging a photosensitive member comprising an electroconductive layer, a photoconductive layer and an insulation layer in a superposed arrangement to a surface potential of specified polarity and at the same time exposing the photosensitive member to a negative image, the second step of irradiating the photosensitive member with light, the third step of charging the photosensitive member by an a.c. corona charger to reduce the surface potential approximately to zero, the fourth step of exposing the photosensitive member to a positive image to form a composite electrostatic latent image, and a fifth step of developing the composite electrostatic latent image by applying a predetermined bias voltage to a developing electrode. The second method of forming a composite image comprises the first step of charging a photosensitive member similarly comprising an electroconductive layer, a photoconductive layer and an insulation layer in a superposed arrangement to a surface potential of specified polarity and at the same time exposing the photosensitive member to a negative image, the second step of exposing the photosensitive member to a positive image, the third step of charging the photosensitive member by an a.c. corona charger to reduce the surface potential approximately to zero, the fourth step of irradiating the photosensitive member with light to form a composite electrostatic latent image, and the fifth step of developing the composite electrostatic latent image by applying a predetermined bias voltage to a developing electrode.

DETAILED DESCRIPTION OF THE INVENTION

A first composite image forming method of the invention will now be described.

Figures 1A, 1B, 1C, 1D:
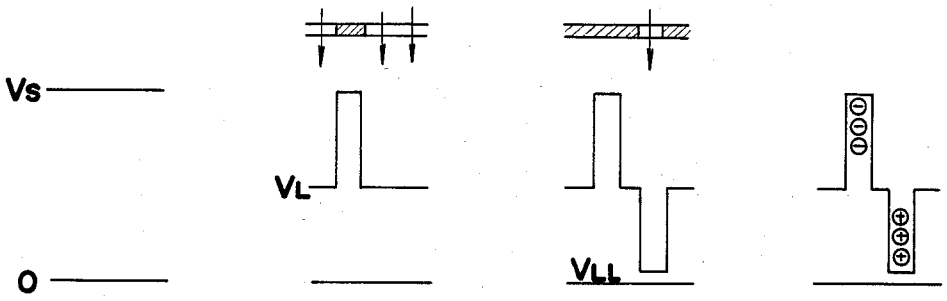
Prior Art FIG.1a FIG.1b FIG.1c FIG.1d
FIGS. 1*a* to 1*d* are diagrams illustrating the steps of a conventional composite image forming method in terms of potential distribution.
Figure 2:
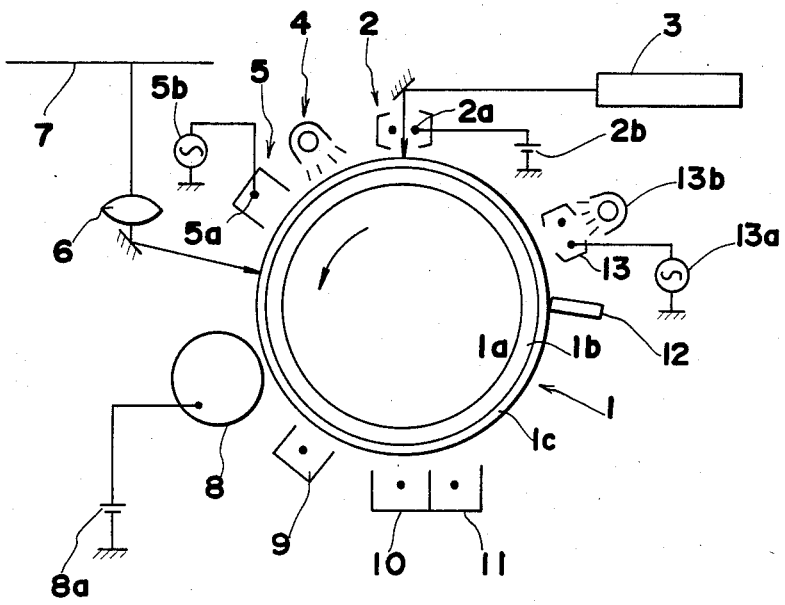
FIG. 2 is a diagram schematically showing the construction of a copying machine for practicing a first composite image forming method according to the invention.

FIG. 2 generally shows the construction of a copying machine which is adapted to practice the first method of the invention for forming composite images. Indicated at 1 is a composite photoresponsive member in the form of a photosensitive drum rotatable counterclockwise and consisting essentially of three layers, i.e. an electroconductive layer 1*a*, a photoconductive layer 1*b* formed over the layer 1*a* and a light-transmitting insulation layer 1*c* provided over the layer 1*b*. For example, a three-layer structure is usable which comprises an electroconductive layer of aluminum, a 10- to 60-micron-thick photoconductive layer formed over the aluminum layer and prepared from a dispersion of CdS, ZnO, $CdS.nCdCO_3$ or the like in a binder resin by coating the layer or prepared from amorphous silicon, and a 10- to 60-micron-thick film of polyester or acrylic resin formed over the photoconductive layer. A simultaneous exposure corona charger 2 includes a corona electrode 2*a* connected to a d.c. voltage source 2*b* for uniformly charging the photosensitive drum 1 to a specified polarity. Simultaneously with charging, the photosensitive drum 1 is exposed to a negative image by a negative latent image forming means 3 such as a laser scanner, OFT, array of light-emitting diode or the like. The corona charger 2 is not limited to a corotron charger but can be a scorotron charger which is very effective for assuring uniform charging.

Indicated at 4 is an entire exposure lamp for uniformly irradiating the photosensitive drum surface with light. An erasing a.c. corona charger 5 includes a corona electrode 5*a* connected to an a.c. voltage source 5*b*. An optical system 6 for projecting a positive original 7 on the drum 1 cooperates with the negative latent image forming means 3 to form a composite latent image.

The composite latent image formed is developed by a magnetic brush developing roller 8 having a developing electrode which is connected to a d.c. bias voltage source 8*a* suitable for applying a predetermined bias voltage Vb to the electrode. A toner of a first polarity is deposited, by normal development, on the latent image corresponding to the negative image, while another toner of a second polarity is deposited, by reversal development, on the latent image corresponding to the positive image. Further indicated at 9 is a precharging corona charger for causing the toners of different polarities to have the same polarity, at 10 a transfer corona charger for transferring the developed composite image onto copy paper, at 11 a separating corona charger for separating the image-bearing paper from the drum 1, at 12 a blade cleaner for removing the remaining toner from the drum surface, and at 13 an a.c. corona charger for erasing charges simultaneously with irradiation by a charge erasing lamp 13*b*. The charger 13 has a corona electrode connected to an a.c. voltage source 13*a*.

The first composite image forming method of the invention is practiced in the following manner by the copying machine of the above construction.

Figure 3A:
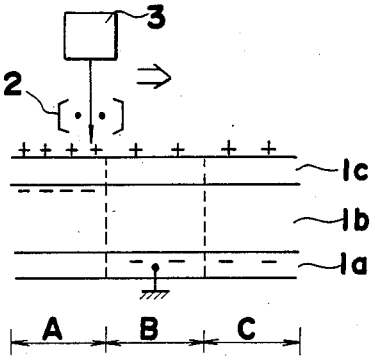
FIGS. 3*a* to 3*d* are diagrams showing steps of the first method of the invention.
Figure 4A:
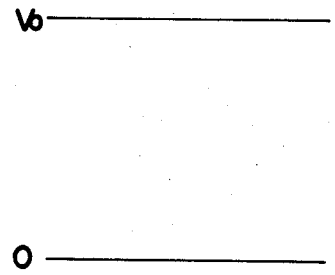
FIGS. 4*a* to 4*d* are diagrams showing potential patterns produced by the steps shown in FIGS. 3*a* to 3*d*.

In the first step, the photosensitive drum 1 is uniformly charged by the corona charger 2 and, at the same time, is exposed to a negative image by the negative latent image forming means 3. This step is shown in FIG. 3*a*, in which for convenience sake, the drum 1 having the three-layer structure of electroconductive layer 1*a*, photoconductive layer 1*b* and insulation layer 1*c* is divided into three equal portions A, B and C, and it is assumed that the portion A is exposed to the image area (irradiated area) of the negative image and that the portions B and C correspond to the nonimage area thereof. Suppose the drum 1 is charged to positive polarity, for example In the portion A which is exposed to the image area of the negative image simultaneously therewith, negative charges are induced at the interface between the insulation layer 1*c* and the photoconductive layer 1*b* relative to the positive charges on the insulation layer 1*c*. In the portions B and C which are not irradiated, negative charges are induced in the electroconductive layer 1*a* in opposite relation to the charges on the insulation layer 1*c*. Although the amount of charges on the insulation layer 1*c* is different between the portion A and the portions B and C owing to a difference in capacitance, these portions have the same surface potential. Thus, the first step uniformly charges the drum 1 to a surface potential V0 as seen in FIG. 4*a*.

Figure 3B:
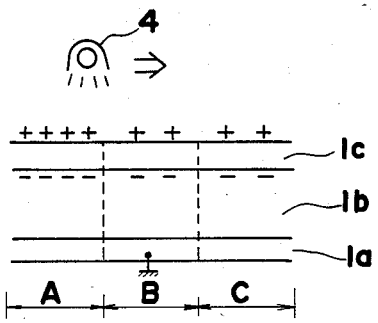
Figure 4B:
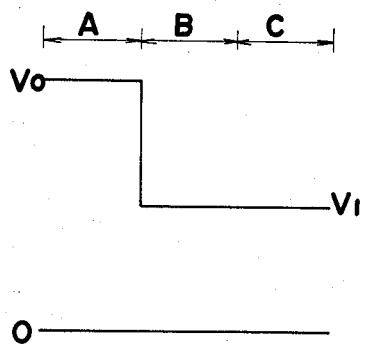

Subsequently in the second step, the drum 1 is uniformly irradiated by the entire exposure lamp 4. As shown in FIG. 3*b*, virtually no change occurs in the portion A, but the charges in the electroconductive layer 1*a* move to the interface between the insulation layer 1*a* and the photoconductive layer 1*b* in the portions B and C. With this movement, the surface potential of the portions B and C decreases to V1, while that of the portion A remains at V0 as shown in FIG. 4*b*. In other words, the surface potential of the portion A, as well as that of the portions B and C, is dependent on the charges on the insulation layer 1*c* and the charges at the interface between the layer 1*c* and the photoconductive layer 1*b*, and the amount of charges is larger in the portion A than in the portion B or C.

Figure 3C:
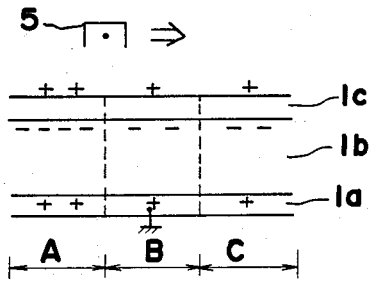
Figure 4C:
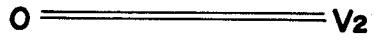

In the third step, the photosensitive drum 1 is charged by the erasing a.c. corona charger 5 to reduce the surface potential approximately to zero. When the drum 1 is charged by the corona charger 5, the amount of positive charges on the surface of the insulation layer 1*c* reduces, while positive charges are induced in the electroconductive layer 1*a* in corresponding relation to the reduction as seen in FIG. 3*c*. The apparent surface potential therefore decreases to V2 approximate to zero volt as shown in FIG. 4*c*. However, although the amount of charges on the insulation layer 1*c* reduces, an amount of charges remains on the layer 1*c* in each portion in proportion to the corresponding amount of charges in the second step.

Figure 3D:
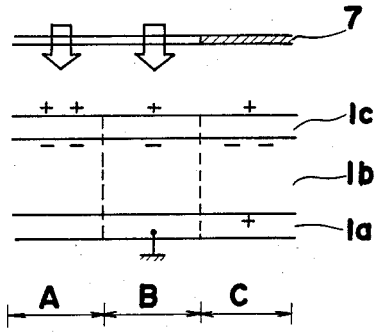
Figure 4D:
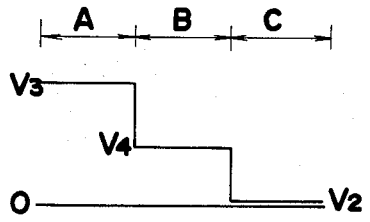

In the fourth step, the positive original 7 is projected on the drum 1 by the optical system 6. When it is assumed that the positive original 7 has its image area (unirradiated area) projected on the portion C and its nonimage area (irradiated area) projected on the portions A and B as seen in FIG. 3*d*, the portion C, corresponding to the image area and not irradiated with light, remains unchanged potentially, thus retaining the surface potential V2 which is approximate to zero as seen in FIG. 4*d*. On the other hand, the light irradiating the portion B excites the photoconductive layer 1*b* to partly neutralize the negative charges at the interface between the insulation layer 1*c* and the photoconductive layer 1*b*, with the result that the potential rises to an intermediate level V4 owing to the presence of the remaining negative charges and the positive charges on the insulation layer 1*c*. While the potential also rises in the portion A which is irradiated with light like the portion B, the amount of charges on opposite sides of the insulation layer 1*c* is larger than that in the portion B, so that the potential rises to V3 which is well above V4. In this way, a composite electrostatic latent image is formed on the drum 1. The composite latent image comprises the three potential values, i.e. the potential corresponding to the image area of the negative image and represented by V3, the potential corresponding to the background area thereof and represented by V4, and the potential corresponding to the image area of the positive image and represented by V2. It is to be noted that the potentials, especially V3 and V4, are determined by the amount of charges on opposite sides of the insulation layer 1*c*. This means that the intermediate potential V4 and the potentials for the image areas can be obtained with good stability at all times without the necessity of delicately adjusting the amount of exposure. If the fourth step gives at least a definite amount of exposure, the potentials V3 and V4 will be dependent only on the amount of charges on opposite sides of the insulation layer and become stable even when repeated use produces variations in the sensitivity of the photosensitive drum. Suppose the photoconductive layer 1*b* and the insulation layer 1*c* each have a capacitance of 150 pF/cm$^2$. The potential levels afforded by the foregoing steps are then as follows: V0=1000 V, V1=500 V, V2= about 0 V, V3=500 V and V4=250 V. More analytically, V3 and V4 are expressed by the following equations (1) and (2).

$$V3 = \frac{C1}{C1 + C2} V0 \quad (1)$$

$$V4 = \frac{C1\ C2}{(C1 + C2)^2} V0 \quad (2)$$

wherein C1 is the capacitance of the insulation layer 1*c*, and C2 is the capacitance of the photoconductive layer 1*b*. The above equations reveal that V3 and V4 are dependent on the capacitances C1, C2 of the insulation layer and the photoconductive layer and on the initial surface potential V0 of the first step, further indicating that these potentials become stabilized sustantially insofar as at least a definite amount of exposure is given.

When the image area of the positive image projected in the fourth step overlaps the image area of the negative image projected (on the portion A) in the first step, the positive image will be formed in preference to the negative image according to the present invention. More specifically, if the portion A, in addition to the portion C, also corresponds to the image area of the positive original 7 in FIG. 3*d*, the portion A is not irradiated with light either in the fourth step and therefore retains the potential V2 which is approximately zero. In other words, the potential of the portion A remains V2 irrespective of the previous history. Thus, the potential pattern of the electrostatic latent image eventually obtained on completion of the fourth step comprises V2 (approx. zero) for the portions A, C and V4 for the portion B.

Figure 5:
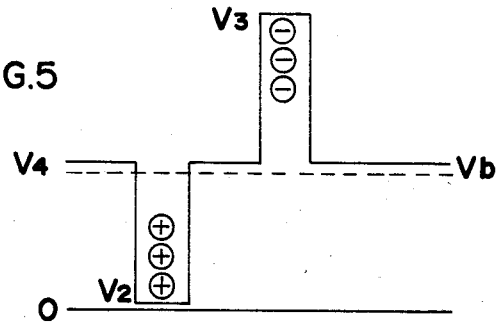
FIG. 5 is a diagram showing a developing step.

The composite electrostatic latent image formed by the first to fourth steps in this way is then subjected to the fifth step, in which the image is developed by the magnetic brush developing roller 8 to which a predetermined developing bias voltage Vb is applied from the d.c. bias voltage source 8*a* More specifically, the composite latent image comprising the three potential values as seen in FIG. 4*d* is developed by setting the bias voltage Vb at a level approximately equal to or slightly lower than the intermediate potential V4 as shown in FIG. 5 and using two kinds of developer toners which differ from each other in polarity. The toner of positive polarity is deposited by reversal development on the positive image area represented by the potential V2, while the toner of negative polarity is deposited by normal development on the negative image area represented by the potential V3. The toners may be of the same color, but if toners of different colors, e.g. black and red, are used, the positive and negative image areas will be developed in the different colors, hence convenient for discrimination. If the positive image area projected in the fourth step overlaps the negative image area, the positive image is formed in preference as already stated and is therefore developed by reversal mode at the overlap.

The fifth step will be described in detail. Preferably the magnetic brush process is used for development. The composite latent image may be developed by a single developing process using a developer comprising two kinds of toners charged to polarities different from each other and iron carrier particles and applying the bias voltage Vb to the developing roller. Alternatively two developing units may be arranged side by side to effect normal development and reversal development separately. Normal development and reversal development can be carried out by a single process further with use of the two-component developer disclosed in U.S. Pat. No. 4,284,702 granted to the present assignee. This developer comprises at least two components, i.e. a nonmagnetic insulating toner and a high-resistivity magnetic carrier about 5 to about 40 microns in particle size, triboelectrically chargeable with the toner and having a high resistivity of at least $10^{12}$ ohm-cm, the carrier being prepared from a dispersion of fine magnetic particles in an insulating resin and containing the fine magnetic particles in a proportion of 50 to 75% by weight based on the whole amount of the carrier particles. The developer is highly superior to conventional ones especially in resolution and latitude. Stated more specifically, the high-resistivity magnetic carrier and the nonmagnetic insulating toner are agitated and thereby triboelectrically charged to polarities opposite to each other to develop the composite latent image, using a magnetic brush developing unit disclosed, for example, in U.S. Pat. No. 4,338,880. In this process, the toner and the carrier are deposited, each with a given width of threshold values, on the image area of the negative latent image and the image area of the positive latent image, respectively, by the application of the developing bias voltage Vb which is approximately equal to or slightly lower than the intermediate potential V4. The carrier and toner of the developer, if colored in different colors, also assure convenient discrimination.

When the positive image only is formed in preference, the toner alone is deposited by reversal development.

The photosensitive drum 1 having the composite latent image thus developed thereon is subsequently charged by the precharging corona charger 9 to negative polarity opposite to the polarity of the first step, whereby the two kinds of toners or the carrier and toner, which are different in polarity, are made to have the same polarity. However, when the toner image is to be transferred by pressure or heat, the precharging corona charger is unnecessary. Next, the developed image is transferred onto copy paper by applying positive corona ions to the rear surface of the paper by the transfer corona charger 10. The copy paper is thereafter separated by the separating corona charger 11 and has the toner image fixed thereto by an unillustrated fixing unit, giving a finished copy. On the other hand, the developer remaining on the drum 1 is removed by the blade cleaner 12, and the residual charges are then removed by the erasing a.c. corona charger 13 and the erasing lamp 13*b* which are turned on at the same time.

Figure 6:
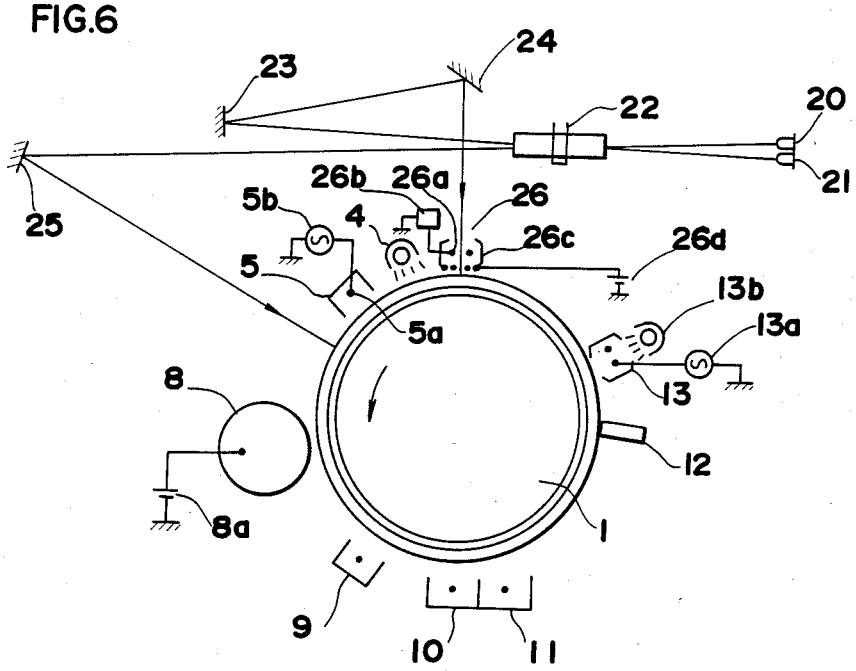
FIG. 6 is a diagram showing another embodiment of copying machine for practicing the first method of the invention.

FIG. 6 shows another embodiment of copying machine adapted to practice the first composite image forming method of the invention. The same parts as those shown in FIG. 2 individually in corresponding relation will be referred to each by the same corresponding numeral and will not be described. With reference to FIG. 6, semiconductor lasers 20 and 21 are adapted for projecting a negative image and a positive image, respectively, as modulated by a polygonal mirror 22. The photosensitive drum 1 is exposed to the negative image through reflecting mirrors 23 and 24 and to the positive image through a reflecting mirror 25. The drum 1 is charged by a scorotron charger 26 and, at the same time, exposed to the negative image from the semiconductor laser 20. The scorotron charger 26 includes a corona electrode 26*a* connected to a high-voltage a.c. or d.c. power supply 26*b* and a grid electrode 26*c* interposed between the corona electrode and the drum and connected to a d.c. bias voltage source 26*d*. The scorotron charger of such structure has the advantage that the drum 1 can be uniformly charged to a potential approximately equal to the bias voltage Vg applied to the grid electrode 26*c* by the d.c. voltage source 26*d*.

When the drum 1 of the copying machine is charged by the scorotron charger 26, the drum is simultaneously exposed to a negative image by the semiconductor laser 20, whereby the drum 1 is uniformly charged to a potential of V0 as already stated with reference to FIGS. 3*a* and 4*a*. Subsequently the drum 1 is uniformly irradiated by the entire exposure lamp 4 (corresponding to FIGS. 3*b* and 4*b*) and further charged by the erasing a.c. corona charger 5 (corresponding to FIGS. 3*c* and 4*c*). Next, the drum 1 is exposed to a positive image by the semiconductor laser 21 to form a composite electrostatic latent image having a potential pattern like the one shown in FIG. 4*d*. When the positive image area overlaps the negative image area at this time, the positive image is formed in preference to the negative image as already described. The composite latent image formed is then developed by the magnetic brush developing roller 8 with application of a bias voltage Vb as illustrated in FIG. 5 and thereafter transferred to copy paper in the same manner as above. The remaining toner and charges are removed from the drum 1, which is thus made ready for the next copying cycle.

Figure 7:
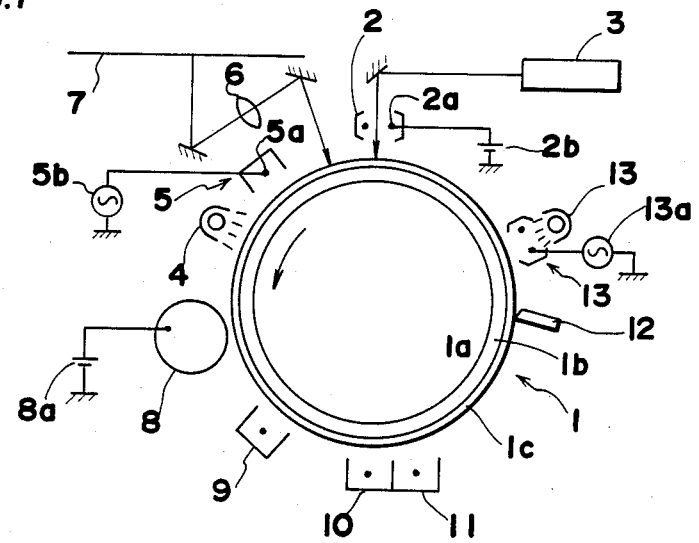
FIG. 7 is a diagram schematically showing the construction of a copying machine for practicing a second composite image forming method according to the invention.

Next, a second method of the invention for forming composite images will be described with reference to FIG. 7. In FIGS. 7 and 2, like parts are referred to by like reference numerals and will not be described again. The copying machine of FIG. 7 has substantially the same construction as the one shown in FIG. 2 with the exception of the following arrangement only. An optical system including a lens 6 for projecting a positive original 7 on the surface of a photosensitive drum 1 of three-layer structure, an erasing a.c. corona charger 5 and an entire exposure lamp 4 are arranged, in the order mentioned in the direction of rotation of the drum 1, subsequent to a corona charger 2 for charging the drum 1 simultaneously when the drum is exposed to a negative image by negative latent image forming means 3.

The copying machine of FIG. 7 described forms a composite image in the following manner.

Figure 8A:
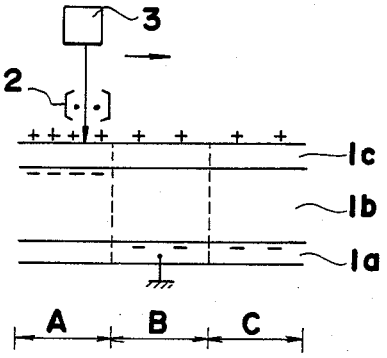
FIGS. 8*a* to 8*d* are diagrams showing steps of the second method of the invention.
Figure 9A:
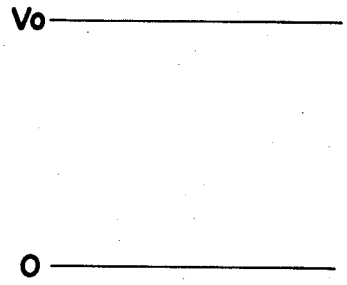
FIGS. 9*a* to 9*d* are diagrams showing potential patterns produced by the steps shown in FIGS. 8*a* to 8*d*.

FIGS. 8*a* and 9*a* show the first step, in which it is assumed that the drum 1 is charged to positive polarity as in FIGS. 3*a* and 4*a*. The portion A is exposed to the image area of a negative image simultaneously with charging, so that in this portion, negative charges are induced at the interface between the insulation layer 1*c* and the photoconductive layer 1*b* relative to the positive charges on the insulation layer 1*c*. In the portions B and C which are not irradiated, negative charges are induced in the electroconductive layer 1*a* in opposite relation to the charges on the insulation layer 1*c*. Although the amount of charges on the insulation layer 1*c* differs between the portion A and the portions B and C owing to a difference in capacitance, these portions have the same surface potential. Thus, the first step uniformly charges the drum 1 to a surface potential V0 as seen in FIG. 9*a*.

Figure 8B:
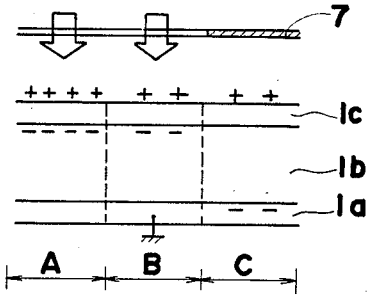
Figure 9B:
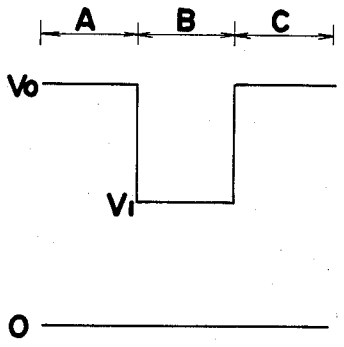

Subsequently in the second step, a positive original 7 is projected on the drum 1 by the optical system. When it is assumed that the positive original 7 has its image area (unirradiated area) projected on the portion C and its nonimage area (irradiated area) projected on the portions A and B as seen in FIG. 8*b*, the portion C, corresponding to the image area and not irradiated with light, remains unchanged potentially, thus retaining the surface potential V0 as shown in FIG. 9*b*. The portion A, which is irradiated with light in the first step, has charges on opposite sides of the insulating layer 1*c* and therefore remains unaffected in any way even when irradiated again in the second step, thus retaining the initial surface potential V0. On the other hand, in the portion B which is irradiated with light, the negative charges in the electroconductive layer 1*a* move to the interface between the insulation layer 1*c* and the photoconductive layer 1*b*. As a result, the potential of the portion B decreases to V1.

Figure 8C:
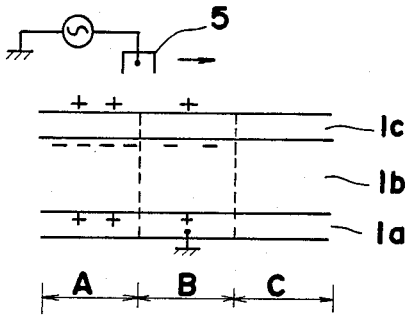
Figure 9C:
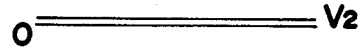

In the third step, the photosensitive drum 1 is charged by the erasing a.c. corona charger 5 to reduce the surface potential approximately to zero. When the drum 1 is charged by the corona charger 5, the amount of positive charges on the surface of the insulation layer 1*c* decreases, while positive charges are induced in the electroconductive layer 1*a* in corresponding relation to the decrease as shown in FIG. 8*c*. The apparent surface potential therefore decreases to V2 approximate to zero volt as shown in FIG. 9*c*. In the portion C, however, this step eliminates the charges present on the insulation layer and in the electroconductive layer.

In the fourth step, the entire exposure lamp 7 uniformly irradiates the drum 1. Consequently the charges on opposite sides of the photoconductive layer 1*b* disappear. More specifically, charges escape from the electroconductive layer 1*a* owing to the irradiation of this step, while charges remain in the portions A and B on opposite sides of the insulation layer 1*c*. The potential rises in the portions A and B in accordance the amount of charges, with the result that the portion A has the highest potential V3 and the portion B an intermediate potential V4. On the other hand, the portion C from which the charges disappeared in the third step retains the potential V2 which is approximate to zero.

The foregoing steps form on the photosensitive drum a composite electrostatic latent image which comprises the three potential values, i.e. the potential corresponding to the image area of the negative latent image and represented by V3, the potential corresponding to the background area thereof and represented by V4, and the potential corresponding to the image area of the positive latent image and represented by V2. The potentials V3 and V4 are represented by the forementioned equations (1) and (2) also in this case. Thus, V3 and V4 are determined by the capacitances C1, C2 of the insulation layer and the photoconductive layer and by the initial surface potential V0 of the first step. This indicates that the potentials become stabilized when at least a definite amount of exposure is assured.

Figure 8D:
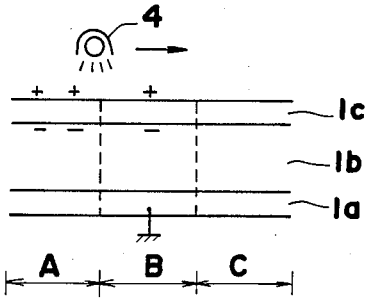
Figure 9D:
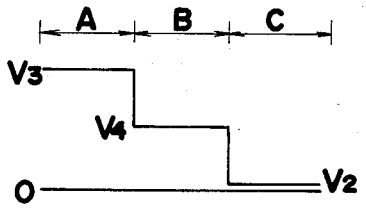

When the image area of the positive image projected in the second step overlaps the image area of the negative image projected (on the portion A) in the first step, the negative image will be formed in preference to the positive image according to the present invention. More specifically, if the portion A, in addition to the portion C, also corresponds to the image area of the positive original 7 in FIG. 8*d*, the portion A is not irradiated with light either in the second step. The portion A, however, is not influenced in any way irrespective of whether it is irradiated. Accordingly preference is given to the negative image formed by the exposure of the first step, and the potential pattern shown in FIG. 9*d* is obtained.

The composite electrostatic latent image formed by the first to fourth steps in this way is subjected to the next fifth step, in which the image is developed by the magnetic brush developing roller 8 at a predetermined bias voltage vb applied by the d.c. bias voltage source 8*a*. More specifically, the composite latent image comprising the three potential values as seen in FIG. 9*d* is developed by setting the bias voltage Vb at a level approximately equal to or slightly lower than the intermediate potential V4 as shown in FIG. 5 and using two kinds of developer toners which differ from each other in polarity. The toner of positive polarity is deposited by reversal development on the positive image area represented by the potential V2, while the toner of negative polarity is deposited by normal development on the negative image area represented by the potential V3. The toners may be of the same color, but if toners of different colors, e.g. black and red, are used, the positive and negative image areas will be developed in the different colors, hence convenient for discrimination.

As in the machine of FIG. 2, the developing step is followed by further steps using the precharging corona charger 9, transfer corona charger 10, separating corona charger 11, blade cleaner 12 and erasing a.c. corona charger 13, whereupon the machine is made ready for the next copying cycle.

Figure 10:
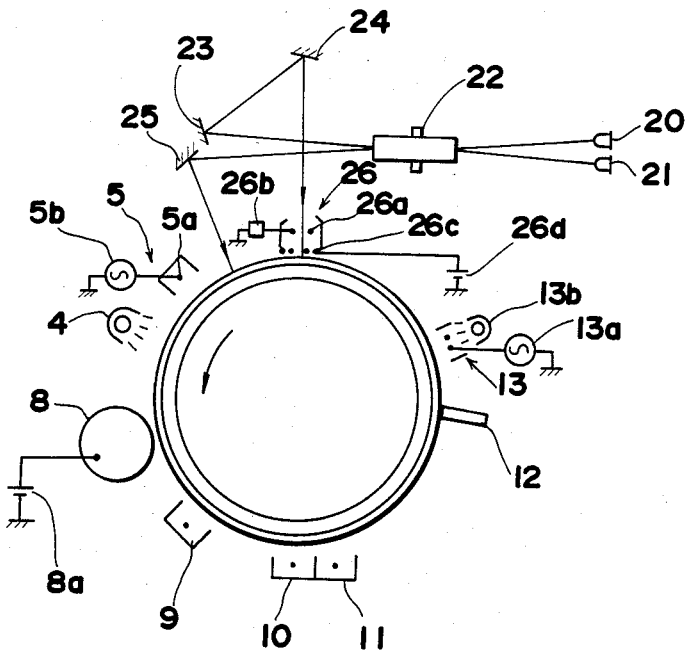
FIG. 10 is a diagram showing another embodiment of copying machine for practicing the second method of the invention.

FIG. 10 shows another embodiment of copying machine which is adapted to practice the above second method of forming composite images. In FIGS. 10 and 7, like parts are referred to by like reference numerals and will not be described. The photosensitive drum 1 of the copying machine is charged by the scorotron charger 26 and, at the same time, exposed to a negative image by the semiconductor laser 20. The drum 1 is uniformly charged to a potential of V0 as already described with reference to FIGS. 8*a* and 9*a*. The drum 1 is then exposed to a positive image by the semiconductor laser 21 (see FIGS. 8*b* and 9*b*) and further charged by the erasing a.c. corona charger 5 (see FIGS. 8*c* and 9*c*). The drum is thereafter uniformly irradiated by the entire exposure lamp 4 to form a composite electrostatic latent image. The composite latent image formed is then developed by the magnetic brush developing roller 8 with application of a bias voltage Vb as shown in FIG. 5 and thereafter transferred to copy paper in the same manner as above. The remaining toner and charges are removed from the drum 1, which is thereby made ready for the next copying cycle.

Numerous modifications and variations of the present invention are possible in light of the above teachings and, therefore, within the scope of the appended claims, the invention may be practiced otherwise than particulary described.

What is claimed is:

1. A method of forming composite images comprising:

a first step of charging and simultaneously exposing a composite photoresponsive member having a electroconductive base, a photoconductive layer and an insulation layer to a negative image;

a second step of irradiating said photoresponsive member with light, a third step of charging said photoresponsive member with an alternating-current charging means to reduce the surface potential charged in the first step to approximately zero;

a fourth step of exposing said photoresponsive member to a positive image thereby forming a composite electrostatic latent image; and a fifth step of developing said composite electrostatic latent image.

2. A method of forming composite images comprising:

a first step of charging a composite photoresponsive member including an electroconductive base, a photoconductive layer and an insulation layer in a superposed arrangement to a predetermined surface potential of a specific polarity while simultaneously exposing it to a negative image;

a second step of irradiating said photoresponsive member with light;

a third step of charging said photoresponsive member by an a.c. corona charging means to make said surface potential approximately zero;

a fourth step of exposing said photoresponsive member to a positive image thereby forming a composite electrostatic latent image of the negative and positive images;

a fifth step of developing said composite electrostatic latent image by a development electrode while applying a predetermined bias voltage to said development electrode; and a sixth step of transferring the developed composite image to a paper.

3. A method as claimed in claim 2 wherien said composite electrostatic latent image formed in the fourth step has a first potential of lowest value corresponding to an image portion of the positive image, an intermediate potential higher than the first potential and corresponding to a background portion and a second potential of highest value corresponding to an image portion of the negative image.

4. A method as claimed in claim 3 wherein the bias voltage applied in the fifth step is set to a voltage substantially equal to or somewhat lower than the intermediate potential.

5. A method as claimed in claim 2 wherein when an image portion of the positive image exposed in the fourth step overlaps with an image portion of the negative image exposed in the first step, the image portion of the positive image is formed in preference to the negative image.

6. A method of forming composite images comprising:

a first step of charging and simultaneously exposing a composite photoresponsive member having an electroconductive base, a photoconductive layer and an insulation layer to a negative image;

a second step of exposing said photoresponsive member to a positive image;

a third step of charging said photoresponsive member by an a.c. charging means to reduce the surface potential charged in the first step to approximately zero;

a fourth step of irradiating said photoresponsive member with light to form a composite electrostatic latent image; and a fifth step of developing said composite electrostatic latent image.

7. A method of forming composite images comprising:

a first step of charging a composite photoresponsive member including an electroconductive base, a photoconductive layer and an insulation layer in a superposed arrangement to a predetermined surface potential of a specific polarity while simultaneously exposing it to a negative image;

a second step of exposing said photoresponsive member to a positive image;

a third step of charging said photoresponsive member by a.c. corona charging means to reduce the surface potential approximately to zero;

a fourth step of irradiating said photoresponsive member with light to form a composite electrostatic latent image of the negative and positive images;

a fifth step of developing said composite electrostatic latent image by a development electrode while applying a predetermined bias voltage to said development electrode; and a sixth step of transferring the developed composite image to a paper.

8. A method as claimed in claim 7 wherein said composite electrostatic latent image formed in the fourth step has a first potential of lowest value corresponding to an image portion of the positive image, an intermediate potential higher than the first potential and corresponding to a background portion and a second potential of highest value corresponding to an image portion of the negative image.

9. A method as claimed in claim 8 wherein the bias voltage applied in the fifth step is set to a voltage substantially equal to or somewhat lower than the intermediate potential.

10. A method as claimed in claim 7 wherein when an image portion of the positive image exposed in the second step overlaps with an image portion of the negative image exposed in the first step, the image portion of the negative image is formed in preference to the positive image.

* * * * *